United States Patent [19]

Constantine

[11] 4,281,766

[45] Aug. 4, 1981

[54] METHOD AND APPARATUS FOR SORTING BODIES OF DIFFERENT DENSITIES

[76] Inventor: Alan Constantine, 573 Bolton Rd., Bury, Greater Manchester, England

[21] Appl. No.: 99,816

[22] Filed: Dec. 3, 1979

[30] Foreign Application Priority Data

Dec. 6, 1978 [GB] United Kingdom ..... 47380/78

[51] Int. Cl.[3] ..... B07C 5/00

[52] U.S. Cl. ..... 209/637; 209/640

[58] Field of Search ..... 209/637, 638, 640, 641, 209/642

[56] References Cited

U.S. PATENT DOCUMENTS 3,047,149 7/1962 Koning ..... 209/638

FOREIGN PATENT DOCUMENTS 503231 10/1937 United Kingdom ..... 209/640

*Primary Examiner*—Allen N. Knowles

*Attorney, Agent, or Firm*—Sughrue, Mion, Zinn, Macpeak and Seas

[57] ABSTRACT

To sort first bodies from a mixture of first and second bodies in which the first bodies, for example potatoes or other root crop, are less dense than the second bodies, for example stones harvested simultaneously with the root crop, the mixture is dropped down a vertical pathway onto an energy absorber. This comprises spaced resilient strips disposed side by side in a common plane transverse to the vertical. The impact of the denser second bodies bends the strips down sufficiently to allow the second bodies to continue along the pathway past the energy absorber. But the less dense first bodies only bend the strips to a lesser extent and are halted thereby. On resiling the strips flick such halted first bodies from the pathway.

10 Claims, 4 Drawing Figures

METHOD AND APPARATUS FOR SORTING BODIES OF DIFFERENT DENSITIES

This invention concerns a method and apparatus for sorting bodies of different densities.

The invention is particularly but not exclusively concerned with the sorting of a root crop, for example sugar beets or potatoes, from stones gathered simultaneously with the crop during harvesting.

A previously known apparatus for sorting a root crop from stones comprises a path down which the crop and stones mixture is dropped. This path is obstructed by a plurality of relatively closely spaced levers extending side by side. Associated with each lever is a respective emitter of x-rays each directing its beam onto a respective receiver. Stones being of greater density than the crop absorb more of the x-rays as they pass through the beams. Accordingly when a receiver detects a high absorption of x-rays, due to a stone passing through the respective beam, a control releases the corresponding lever to allow the stone to pass and then restores the lever to its obstructing position. The absorption of x-rays by an item of the crop is inadequate to make the control respond and accordingly that item is obstructed by one or more levers and directed from the path.

Such a known apparatus is relatively complex and expensive.

An object of the invention is to provide a method which can be carried out relatively simply for sorting bodies of different densities which may be carried out on relatively simple and cheaply constructed apparatus.

According to a first aspect of the invention there is provided a method of sorting first bodies from second bodies in a mixture comprising both in which all the first bodies have substantially the same density which is lower than the density of each of the second bodies, the method comprising delivering the mixture to a vertical pathway obstructed by an energy absorber comprising elongate resilient elements extending side by side, each said element being held at a position along its length, which position is substantially stationary relative to the bodies travelling the pathway, said bodies making impact on the resilient elements so that the energy absorber is resiliently deformed by second bodies to an extent permitting them to pass the energy absorber and continue along the pathway but said energy absorber stops travel of first bodies along the pathway past the energy absorber, and propelling those first bodies from the pathway under the effect of resilient action.

According to a second aspect of the invention there is provided an apparatus to sort first bodies from second bodies in a mixture comprising both in which all the first bodies have substantially the same density which is lower than the density of each of the second bodies, the apparatus comprising a vertical pathway for the delivery thereto of said bodies, said pathway being obstructed by an energy absorber comprising elongate resilient elements extending side by side such that the array of elements extends transversely to the vertical, each element being arranged to be held at a position along its length such that said position is stationary relatively to bodies travelling the pathway, each element having a length portion extending from said position to a free unconstrained end of the element, each said portion being capable of resilient flexing, the arrangement being such that when the bodies make impact upon the energy absorber the energy absorber is resiliently deformed by second bodies to an extent permitting them to pass the energy absorber and continue along the pathway whereas the energy absorber stops travel of first bodies along the pathway past the energy absorber and acts resiliently to provide propulsion of those first bodies from the pathway.

The invention will now be further described by way of example, with reference to the accompanying drawings in which.

Figure 1:
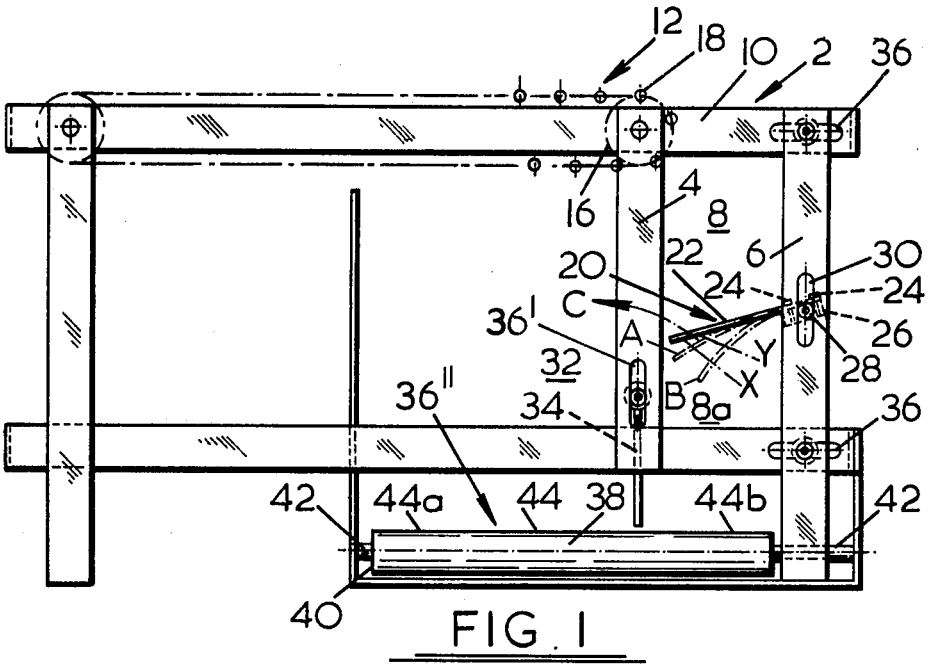
FIG. 1 is a diagrammatic and fragmentary side view of one embodiment of an apparatus formed according to the second aspect of the invention for carrying out the method according to the first aspect of the invention.
Figure 2:
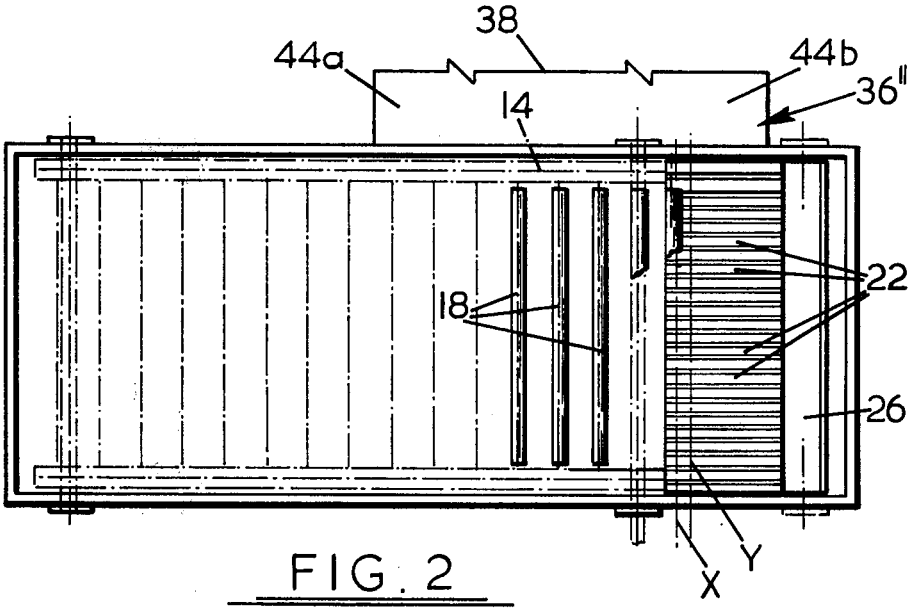
FIG. 2 is a fragmentary plan view of the apparatus of FIG. 1.

With reference to FIGS. 1 and 2 the apparatus shown therein has a frame 2 comprising pairs of posts 4 and 6 between which is defined a vertical pathway 8 at an upper end 10 of which is a dropping point for the mixture of first and second bodies to be sorted (not shown). The first bodies, in the mixture of bodies, have substantially the same density which is less than that of each of the second bodies in the mixture.

An even mixture, i.e. the bodies are side by side and not piled on one another, of the first and second bodies may be supplied to dropping point 10 by conveyor means 12. The conveyor means may be any kind capable of supplying the bodies in the mixture at substantially the same velocity to the dropping point so that the bodies drop more or less straight down the pathway 8 after leaving the conveyor, for example, a driven endless belt conveyor, or, as shown in the drawings, a conveyor comprising two driven endless chains 14 passing around sprockets 16 at the dropping point and interconnected by bars 18 to support the mixture.

An energy absorber 20 is located in the path 8 below the dropping point 10. It will be appreciated that because the first and second bodies falling simultaneously from the dropping point 10 commence their fall at substantially the same downward vertical velocity, the first and second bodies will have either the same or substantially the same vertical velocity when they reach the upper surface of the energy absorber 20 which extends transversely to the vertical across substantially the entire transverse cross-sectional area of the path 8.

The energy absorber 20 comprises a plurality of spaced elongate elements 22 disposed side by side substantially parallel in substantially the same plane in a comb-like manner. The elements 22 are of resilient material, for example steel, and may be in rod or strip form, and the elements themselves are pliably resilient. In the drawings the elements 22 are of strip steel and constitute leaf springs. Each element 22 is firmly secured at one end by, for example, rivets 24 to a generally horizontal stationary bar 26 with end spigots 28 located in elongate slots 30 in the posts 6 to which the bar is releasably clamped.

The spacing between the elements 22 is such that each first body having a diameter greater than the spacing will fall onto at least one of the elements. Also if second bodies have diameters greater than the spacing, they too will strike at least one element 22. The first bodies can be items of a root crop, for example, sugar beets, potatoes, carrots, etc., and the second bodies can be stones harvested simultaneously with the crop.

Because the first bodies have a lower density than the second bodies, the kinetic energy per unit volume of each first body is less than the kinetic energy per unit volume of each second body at the place, for example, between the dotted lines X and Y, along the elements 22 of the energy absorber 20 where the bodies hit it. Accordingly the pressure each body exerts on any element 22, whether a said body strikes one or two or more elements 22 substantially simultaneously, is less for a first body than for a second body.

The construction of each element 22 is such that it bends elastically to such a lesser extent (to position A for example) when hit by a first body than (to position B for example) when hit by a second body, that the first body is halted on the element(s) 22 whereas the element(s) is/are sufficiently bent by the second body to allow the second body to pass into the region 8*a* which is a continuation of the pathway 8.

The energy which the elements 22 absorb from the bodies is stored by each bent element and used to restore the element to its original position as the element resiles. Each element which has a halted first body thereon flicks the first body in the direction of arrow C during the aforesaid resiling so that the first body is directed out of the path 8 to fall into a region 32 on the other side of a partition 34 from the path 8*a*.

Accordingly the first bodies are separated from the second bodies.

In FIG. 1 the element 22 shown in full lines is in its normal un-deformed attitude. Preferably the elements 22 are inclined relative to the horizontal to ensure the first bodies are flicked clear of the path 8. The particular attitude in which the elements 22 are disposed relative to the horizontal can be varied as desired, by, for example, releasing the clamping of the bar 26 and rotating it about its horizontal longitudinal axis.

Although the functioning of the apparatus for a mixture of first bodies of a particular density with second bodies of a particular density, is somewhat predetermined by choosing elements 22 of appropriate size and elasticity, a degree of setting can be achieved by varying the distance the energy absorber 20 is below the dropping point 10. Thus the kinetic energy per unit volume of the bodies can be varied, to ensure for example, that the first bodies do not have too much when they hit the energy absorber. The slots 30 allow the energy absorber to be moved up or down to a limited extent to vary its vertical position. Accordingly the vertical position of the top of the partition 34 may also need to be changed as permitted by elongate slots 36' in the posts 4 to which the partition is releasably clamped.

The horizontal position of each post 6 can be varied within the limits of slots 36, permitting the energy absorber 20 to be moved nearer to or further from the posts 4.

One or more conveyors may be provided to carry away the first bodies from the region 32 and the second bodies from the region 8*a*. In FIGS. 1 and 2 a single such conveyor 36'' is provided constituted by an endless driven belt 38 supported at opposite ends by rollers, only one being shown at 40 on shaft 42, so that the belt has an upper horizontal run 44. The first bodies fall onto side 44*a* of the upper run and the second bodies onto side 44*b*.

The supply to the energy absorber, of the mixture of bodies to be sorted can be continuous.

It may be necessary to provide a number of interchangeable energy absorbers in which the elements 22 of each are elastically pliable to a greater or lesser extent depending on the densities of different types of first bodies. For example, a different energy absorber may be necessary to sort sugar beet from stones than that, for example, for sorting potatoes from stones.

Figure 3:
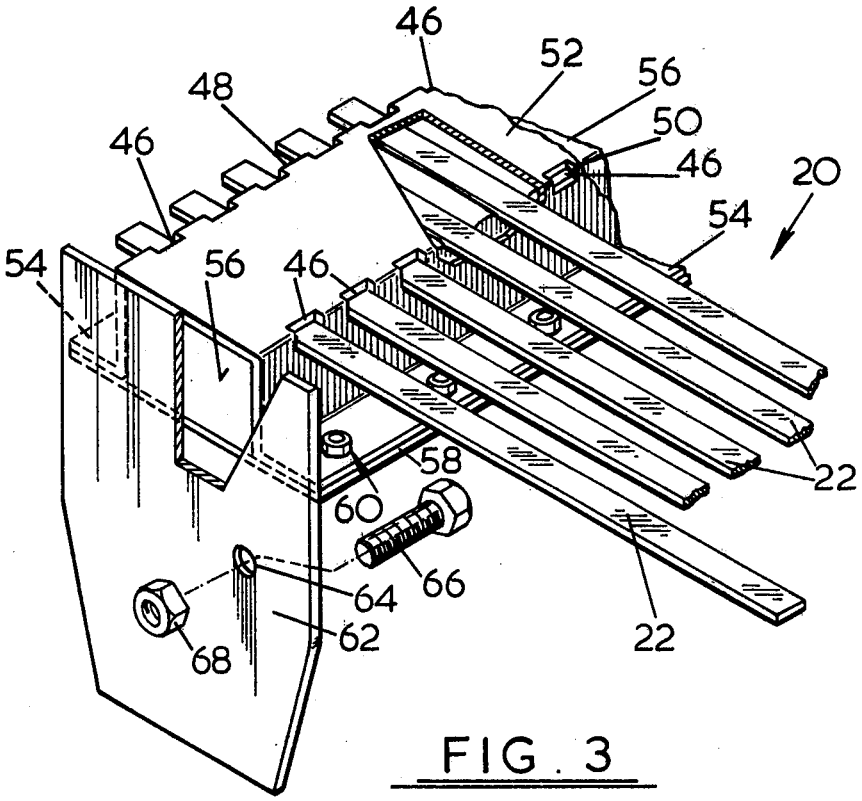
FIG. 3 is a fragmentary perspective view of another embodiment of energy absorber.

FIG. 3 shows an alternative embodiment of the energy absorber 20 in which the elements 22 pass through pairs of holes 46 each formed in a corner 48 or 50 in a channel shaped member 52 of rectangular cross-section formed with base flanges 54. The strip shaped elements 22 are clamped in position by a block of elastomeric material 56 held in place by a clamping plate 58 secured to the flanges by nuts and bolts 60. At each end, the member 52 is welded to a side plate 62 formed with a hole 64 to receive a bolt 66 which in use is also passed through the corresponding slot 30 (FIG. 1) so that a nut 68 threaded on each bolt 66 releasably clamps the energy absorber to the posts 6 so that when desired, the energy absorber may be moved up or down in the slots 30 and the angle of inclination of the elements 22 to the horizontal varied by tilting about the axes of the bolts 66.

The ease with which each element 22 can be bent in the energy absorber in FIG. 3 can be varied by varying the length that each element extends from the member 52. This is achieved by releasing the plate 58 to loosen the elastomeric block 56 which permits the elements 22 to be moved through the holes 46 in or out relatively to the member 52.

Figure 4:
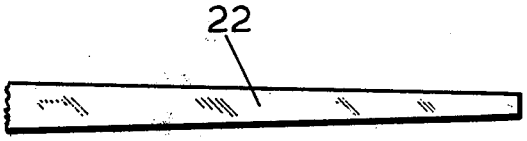
FIG. 4 is a plan view of another embodiment of an elongate resilient element which may be used in the energy absorbers in FIGS. 1 to 3.

The facility with which each element 22 bends may be increased along its length towards the free end of the element by tapering the element towards its free end, such a tapered element being shown in FIG. 4.

The sorting apparatus described above may be mounted stationarily for example on the ground, or the apparatus may be mobile, for example on a harvesting vehicle.

I claim:

1. A method of sorting first bodies from second bodies in a mixture comprising both in which all the first bodies have substantially the same density which is lower than the density of each of the second bodies, said method comprising: delivering first and second bodies in said mixture substantially horizontally at substantially the same velocity to a dropping point at which the continuously moving bodies then fall freely under gravity down a vertical pathway obstructed a distance below the dropping point by an energy absorber comprising a plurality of elongate resilient elements extending side by side, each said element being held at a position along its length substantially stationary relative to the bodies traveling the pathway, and each said element extending in a downwardly inclined attitude from said position to a free end of the element, and when considering a geometric projection of each said element on an imaginary substantially horizontal plane in which said mixture is delivered to said dropping point, the geometric projection of said position on said plane being further along the substantially horizontal direction in which said mixture is delivered to the dropping point than the geometric projection of said free end on said plane, said freely falling bodies making impact on the elements intermediate the free end of an impacted said element and said position so that the energy absorber is deformed by second bodies to an extent permitting them to pass the energy absorber and continue along the pathway but said energy absorber stopping travel of first bodies along the pathway past the energy absorber, and propelling such stopped first bodies from the pathway under the effect of resilient action.

2. A method of sorting as claimed in claim 1, in which resiling of said elements deformed by impact thereon of said first bodies acts to provide propulsion of said first bodies from the pathway.

3. A method of sorting as claimed in claim 1 or claim 2, in which at a location on said energy absorber along the pathway the bodies have substantially the same velocity, whereby because the first bodies have a lower density than the second bodies the kinetic energy per unit volume of each first body is less than the kinetic energy per unit volume of each second body, at said location there is absorbed by the energy absorber an amount of kinetic energy per unit volume of body sufficient to stop further travel of each first body in said direction, the halted first bodies are propelled from said pathway under the effect of resiling of the elements upon which the first bodies make impact, but the energy absorbed by the energy absorber from the second bodies is insufficient to prevent them continuing along the pathway past the energy absorber.

4. An apparatus to sort first bodies from second bodies in a mixture comprising both in which all the first bodies have substantially the same density which is lower than the density of each of the second bodies, the apparatus comprising: conveyor means for delivering first and second bodies in said mixture substantially horizontally and at substantially the same velocity continuously to a dropping point, a vertical pathway leading from the dropping point for the continuously moving bodies at the dropping point to drop freely under gravity along the pathway, said pathway being obstructed a distance below the dropping point by an energy absorber comprising a plurality of elongate resilient elements extending side by side, said array of elements extending transversely to the vertical, each element being held at a position along its length substantially stationary relative to bodies traveling the pathway, each element having a length portion extending from said position to a free unconstrained end of the element, each said portion being capable of resilient flexing and extending in a downwardly inclined attitude from said position to said free end, each said length portion having a geometric projection on an imaginary substantially horizontal plane in which the mixture is delivered to said dropping point and the geometric projection of said position on the plane being further along the substantially horizontal direction in which said mixture is delivered to the dropping point than the geometric projection of said free end on said plane, and the energy absorber being disposed for said freely falling bodies to make impact on the elements intermediate the free end of an impacted said element and said position, the arrangement being such that when the bodies make said impact upon the energy absorber it is resiliently deformed by second bodies to an extent permitting them to pass the energy absorber and continue along the pathway whereas the energy absorber stops travel of first bodies along the pathway past the energy absorber and acts resiliently to provide propulsion of those first bodies from the pathway.

5. An apparatus as claimed in claim 4, in which the conveyor means is an endless conveyor having an upper run, and at least a portion of said upper run leading to and adjacent said dropping point is substantially horizontal.

6. An apparatus as claimed in claim 4, in which the length portion of a said element is variable.

7. An apparatus as claimed in claim 4 or claim 6, in which a said element is a strip.

8. An apparatus as claimed in claim 4, in which a said element tapers towards its free end.

9. An apparatus as claimed in claim 4 in which the inclined attitude of the array of elements relative to a horizontal plane is variable.

10. An apparatus as claimed in claim 4, further comprising a second conveyor means disposed below the energy absorber.

* * * * *